US005201663A

United States Patent [19]

Kikuchi et al.

[11] Patent Number: 5,201,663

[45] Date of Patent: Apr. 13, 1993

[54] CONNECTOR WITH FLEXIBLE MOUNTING FEATURES

[75] Inventors: Shoji Kikuchi, Hiratsuka; Akihito Ono, Machida; Tatsuya Nakamura, Kawasaki, all of Japan

[73] Assignee: AMP Incorporated, Harrisburg, Pa.

[21] Appl. No.: 884,093

[22] Filed: May 15, 1992

[30] Foreign Application Priority Data

Jun. 19, 1991 [JP] Japan ..... 3-173337

[51] Int. Cl.[5] ..... H01R 9/09

[52] U.S. Cl. ..... 439/83; 439/81; 439/82; 439/248

[58] Field of Search ..... 439/76, 79–83, 439/246, 247, 248

[56] References Cited

U.S. PATENT DOCUMENTS

| | | | |
|---|---|---|---|
| 3,673,545 | 6/1972 | Rundle | 439/248 |
| 4,828,503 | 5/1989 | Gilissen et al. | 439/82 |
| 4,898,539 | 2/1990 | Glover et al. | 439/81 |
| 4,917,614 | 4/1990 | Kikuchi et al. | 439/83 |
| 4,954,089 | 9/1990 | Jensen et al. | 439/76 |
| 4,992,056 | 2/1991 | Douty et al. | 439/83 |
| 4,995,816 | 2/1991 | Grabbe | 439/82 |
| 5,073,119 | 12/1991 | Soes | 439/82 |
| 5,122,066 | 6/1992 | Plossmer | 439/81 |

FOREIGN PATENT DOCUMENTS

| | | |
|---|---|---|
| 1-113981 | 7/1989 | Japan . |
| 3-32372 | 3/1991 | Japan . |

*Primary Examiner*—Paula A. Bradley

*Attorney, Agent, or Firm*—Adrian J. LaRue; Timothy J. Aberle

[57] ABSTRACT

An electrical connector (10) includes a first housing part (20) fixed to a circuit board and a second housing part (30) fitted within the first housing part and spaced therefrom to alow limited X, Y, and Z movement between such parts, contacts (40) are provided including solder post portions (42) mounted in the first housing part and contact portions (41) in the second housing part adapted to engage the contacts of a mating housing. The contact portions (41) and (42) are interconnected by an integral S-shaped spring (43) to facilitate limited and resilient movement of the contact portions and housing parts to relieve stresses and strains caused by mating and unmating of components, including further connectors to a circuit board through the connector. An alternative embodiment (10') includes legs (42') and a J-shaped contact portions (40') in the second housing part (30') with the connector (10') being adapted to be surface mounted and soldered on a circuit board.

15 Claims, 1 Drawing Sheet

CONNECTOR WITH FLEXIBLE MOUNTING FEATURES

FIELD OF THE INVENTION

This invention relates to an electrical connector of a type adapted to be mounted on a circuit board such as a printed circuit board or the like, and to facilitate slight movements to reduce stresses caused by mating and unmating with further connectors.

BACKGROUND OF THE INVENTION

Electrical connectors are widely used to interconnect electronic components and subcomponents to each other and to circuits such as circuit boards to form functioning devices. Many such connectors employ multiple contact receptacles and/or posts or pins to provide the interconnection of circuits, and such contacts are arrayed in housings, mounted on circuit boards or made to interconnect wiring cables. Usually, one or the other of the contacts, plug or receptacle, is made to be resilient in order to accommodate manufacturing tolerances of the contacts, slight variations in dimensions and of the contact mountings in connectors or on circuit boards. With higher density connections where very small metal contacts are utilized and larger numbers of contacts per connector are employed, the practice of providing a limited resiliency for each contact has not proven sufficient to avoid stresses and strains to the contacts themselves, to the connector housings, and to the solder terminations to boards to preclude breakage and damage resulting in failure. Slight differences in angle of approach when mating connectors together, side loads inadvertently applied during mating or unmating, shock and vibration, and numerous other external forces can result in this condition.

Examples of connectors having a resiliency may be found in Japanese U.M. laid open Application Numbers 113981/89 and 32373/91. These connectors do provide accommodation for slight misalignments and are useful in the larger sizes, where larger center-to-center spacings are used. But, these prior art devices do not accommodate forces and displacements in more than one or two directions and are difficult to implement in very small sizes.

Accordingly, it is an object of the present invention to provide an electrical connector that accommodates displacement in X, Y, and Z directions while simultaneously providing a structure capable of being rendered on extremely close centers. A further object is to provide an electrical connector wherein the housing of the connector is movable to a limited extent to facilitate mechanical loads caused by misalignment, shock, or vibration, without undue stress on the connector components, contacts, terminals, or solder joints associated with an interconnection between components.

SUMMARY OF THE INVENTION

The present invention achieves the foregoing objectives by providing an electrical connector including a dielectric housing having first and second parts and an array of contacts mounted in the housing to interconnect with a further connector and with a circuit such as a dielectric circuit board. The housing first part is made to contain contact portions aligned in rows to receive contacts from a further connector and the housing second part is made to include second portions of the contacts mounted in or on a circuit board. The first portion of the housing fits within the second portion of the housing with a spacing therearound to facilitate X, Y, and Z movements of the housing first portion relative to the housing second portion and to the board upon which the second housing is mounted. The first and second portions of the housing include surfaces that limit the movement of the first portion within the second portion in X, Y, and Z directions so as to control stress and strain applied to the contacts. The degree of freedom of movement is such so as to accommodate a range of stress and strain loads resulting from misalignment of parts or components or other causes creating such loads. The contacts include an intermediate portion extending between the portion mounted in the first part of a housing and the portion mounted in the second part of the housing that it has a spring shape, an S-shape in the illustrated embodiment, to accommodate relative movement of the different portions of the contact as tied to the different parts of the housing. Thus, the loads of mating and unmating, ideally up and down or in a Z direction can be readily accommodated, the intermediate contact portion serving as a shock absorber relative to each contact and allowing slight relative movements of the housing parts. The first housing part includes horizontal surfaces that engage the circuit board to limit downward movement and upper surfaces that engage the second housing part and limit upward movement in a Z sense. The S-shaped intermediate contact portions allow limited X and Y and Z displacements of the different portions of the contacts and therefore of the first and second parts of the housing as limited by surfaces of the housings that engage one another.

One embodiment of the invention includes a contact portion having a general U-shape adapted to receive a pin or post inserted therein and the other portion of the contact includes a post adapted to be inserted within a hole in a circuit board or the like. Another embodiment of the invention includes J-shaped contacts arranged in two rows adapted to engage pairs of posts in a mating connector and on the second portion of the contact, legs that project downwardly to rest on a circuit board and be surface mounted thereto by solder.

Both embodiments of the invention include contacts stamped and formed out of metallic sheet stock having desirable spring characteristics, such as phosphor bronze or hard brass, with the contacts being set on edge in the housings to reside substantially within the plane of the metal of which they are made and allow high density mounting with spring action of the contacts and the spring action of the intermediate portion thereof being confined to the plane of the metal to thus assure a high density capability.

BRIEF DESCRIPTION OF THE DRAWING

The invention will now be described by way of example with reference to the accompanying drawings in which.

DETAILED DESCRIPTION OF THE INVENTION

Figure 1:
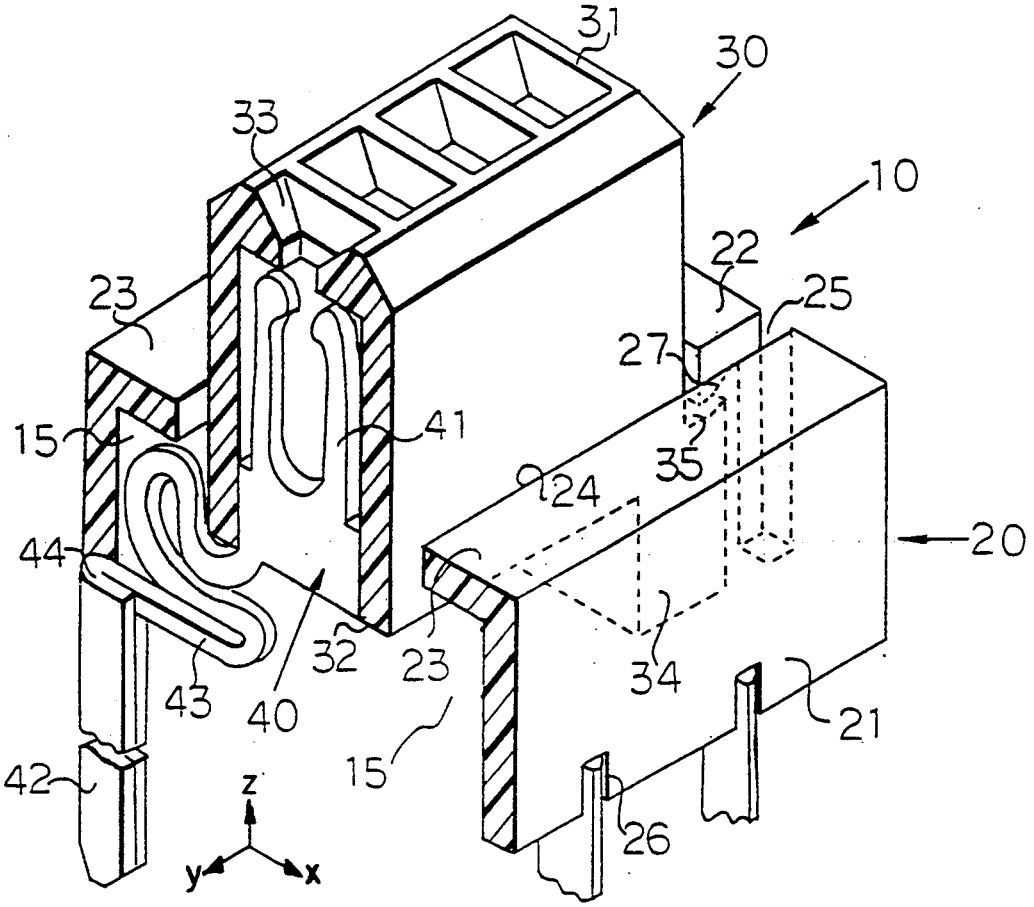
FIG. 1 shows a perspective view of a connector in accordance with one embodiment of the invention, partially sectioned to reveal the housing parts mounting an electrical contact.

Referring now to FIG. 1, a connector 10 is shown to include a housing comprised of first and second parts 20 and 30 containing and mounting therewithin contacts 40. The connector 10 is mounted on a circuit board, not shown, with termination portions 42 of the contacts 40 fitted through holes therein and soldered thereto. A mating connector connected to a component, a cable, or another circuit board, also not shown, would include post portions that fit into the contacts 40 to be interconnected to the circuits of the board upon which connector 10 is mounted.

Housing part 20 is the lower part of the housing and rests upon the circuit board. Part 20 includes side walls 21, end walls 22, and upper surfaces 23 to form a generally rectilinear box-like structure. Interior of part 20 is a recess 15 that extends within the connector and there is an opening or spacing 24 that extends around the interior of the part 20. A slot 25 is provided at the end wall 22 to facilitate a slight movement of the side and end walls. There is an interior tapered surface 27 that extends to define a lip in wall 22 of a purpose to be described. Side walls 21 include, at the lower edge thereof, slots 26 that accommodate portions 42 of the contacts 40 and hold such contacts against displacement relative to housing part 20.

A second housing part 30 includes an upper mating face 31 having apertures 33 extending therethrough adapted to guide the insertion of contact posts from the further connector not shown. Part 30 includes a bottom face 32 and a projection 34 that rests against the surface of the circuit board upon which connector 10 is mounted. Additionally, there is a beveled or dish-shaped surface 35 aligned with the surface 27 but spaced therefrom. Part 30 includes therewithin contacts 40 that include U-shaped contact spring portions 41 within part 30 and post portions 42 held by slots 26 in part 20. An intermediate, resilient spring portion 43 interconnects portion 41 to portion 42 thereby forming post 42 that may be made more rigid by being folded as at 44. The end of 42 can be suitably tapered for ease of installation into the holes of a circuit board. The intermediate portion 43 can be seen to have a general S-shape to allow movement between the portion 41 and the portion 42 of the contact in X, Y, and Z movements; a Z representing an up and down movement relative to the board in which the connector is mounted, and X and Y representing movements in the plane parallel to the board in which the connector is mounted all as represented by the arrow representations in FIG. 1.

As can be appreciated, movement is limited by the spring characteristics of spring portion 43 and is intended to be within a range of the elastic properties of the spring. It can also be appreciated since there is a gap between the parts 20 and 30, the relative movement of contact portions 41 and 42 is limited in X, Y, and Z directions. Thus, for example, displacements in the Y direction would be limited by the wall 22, the interior surface thereof, at each end of housing part 20 and X movements would be limited by engagement with the side edge surfaces of 23 engaging the side walls of part 30. Downward movement, movement in a Z dimension, would be limited by the surface of projection 34 of part 30 engaging the upper surface of the board upon which the connector is mounted, and upper movement would be limited by the engagement of the tapered surfaces 27,35 of part 20 and part 30. These latter limitations are important during the critical mating and unmating of connectors with connector 10, mating driving the housing part 30 downwardly, and unmating drawing or pulling the housing part 30 upwardly. Of course, during mating and unmating of connectors, it is frequently the case that the parts are skewed or misaligned thereby resulting in stresses and strains in the X and Y dimension as well as the Z dimension. The dimensions of the spacing between parts 20 and 30, the spacing 24, the spacing between surfaces 27 and 35, and the exterior surfaces of the housing part 30 are selected so that the relative movements between the parts do not exceed the elastic limits of spring intermediate portions 43 thereby resulting in a set of the contact parts.

Figure 2:
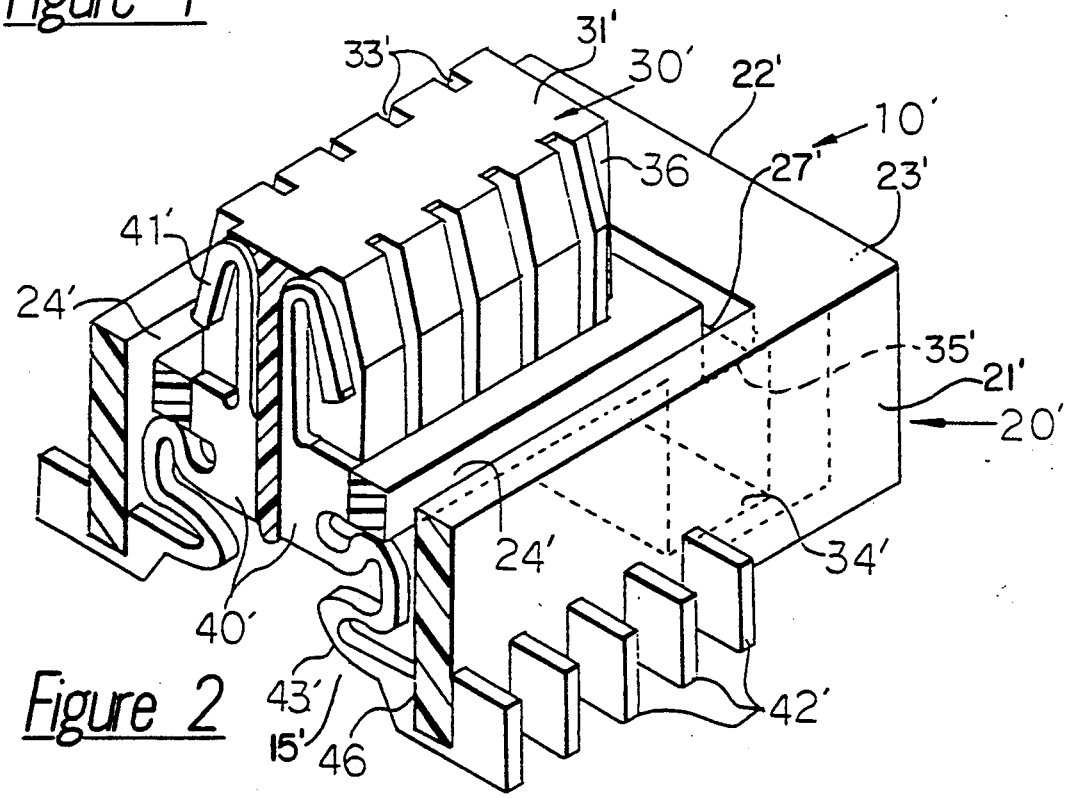
FIG. 2 is a perspective view of an alternative embodiment of the invention, partially sectioned to show the characteristics of electrical contacts of the connector and of the housing portions mounting such contacts.

Referring now to FIG. 2, an alternative embodiment is shown to include contacts 10' having housing parts 20' and 30' and contacts 40'. In the embodiment of FIG. 2, there are two rows of contacts 40', and as in the previous embodiment, there is a space or gap 24' between the parts 20' and 30' extending therearound to allow relative movement between the parts. The housing part 20' includes side walls 21', end walls 22' and an upper surface 23'. The housing part 30' includes the surface 31' with grooves 33' accommodating the contact portions 41' of contacts 40'. Part 30' has a beveled surface 36 adapted to ease entry into a mating receptacle, not shown, carrying contacts that mate with the portions 41' of contacts 40'. Housing part 30' includes a projection 34' that limits downward movement in the Z direction by engagement with the upper surface of a board upon which the connector 10' is mounted. An upwardly facing surface 35' of housing part 30' limits upward movement by engaging surface 27' of housing part 20'.

The contacts 40' include termination leg portions 42' that are slotted as at 46 to embrace the bottom of wall 21' and lock the contacts to such part. The leg portions 42' extend out onto the surface of a circuit board and are intended to be soldered thereto as by the reflow of solder coatings on such legs. The contacts 40' further include intermediate portions 43', generally S-shaped, connecting the upper portions 41' and facilitating slight, resilient X, Y, and Z displacements between the lower and upper portions of the contacts 40'. The connector 10' thus is similar to that of the embodiment of FIG. 1 with respect to allowing resilient movements in three directions, limited by surface engagement of the two housing parts of the connector. The connector 10' includes stampings of a single metal thickness to facilitate high density mounting of contacts. The inventive advantage is particularly important in connectors like that shown in FIG. 2 where the surface mounting as by solder of legs such as 42' can otherwise be subjected to stresses and strains due to plugging and unplugging of mating connectors, moreso than connectors that have posts that fit within the holes of the board as in the embodiment of FIG. 1.

Having now disclosed the invention relative to drawings of preferred embodiments thereof, claims are appended to define what is inventive, it being understood that incorporation of numbers in the claims shall in no way be construed to limit the claims to a reading on the embodiments herein or other embodiments otherwise covered.

We claim:

1. An electrical connector, comprising:

a dielectric housing having a first housing part and a second housing part, said first housing part having an opening through which said second housing part extends with a space therebetween for relative movement therebetween;

electrical contacts having contact portions secured in said first housing part and termination portions secured in said second housing part and extending outwardly therefrom; and intermediate portions of said contacts between said contact portions and said termination portions permitting relative movement between the housing parts.

2. An electrical connector as claimed in claim 1, wherein said intermediate portions are spring members.

3. An electrical connector as claimed in claim 2, wherein said spring members having an S-shape.

4. An electrical connector as claimed in claim 1, wherein said termination portions are posts.

5. An electrical connector as claimed in claim 1, wherein said termination portions are legs.

6. An electrical connector as claimed in claim 1, wherein said first housing part includes cavities, said contact portions define U-shaped spring members secured in said cavities.

7. An electrical connector as claimed in claim 1, wherein said first housing part has recesses disposed in sides thereof, said contact portions define J-shaped members extending along said recesses.

8. An electrical connector as claimed in claim 1, wherein said housing parts have overlapping surfaces limiting upward movement of said second housing part relative to said first housing part.

9. An electrical connector as claimed in claim 1, wherein said second housing has projections to limit downward movement of said second housing part relative to said first housing part.

10. An electrical connector as claimed in claim 1, wherein securing means are provided between said first housing part and said termination portion securing said termination portions in position to said first housing part.

11. An electrical connector for electrical connection to a circuit board, comprising:

a dielectric housing including a first housing part and a second housing part, said first housing part mountable onto the circuit board and having an opening through which said second housing part extends with a space therebetween enabling relative movement between the first and second housing parts;

electrical contacts including contact sections and termination sections, said contact sections secured in said first housing part for electrical connection with matable contact sections of a matable electrical connector, said termination sections secured in said second housing part for electrical connection to conductive areas on the circuit board; and intermediate sections of said contacts between said contact sections and said termination sections permitting relative movement between the housing parts.

12. An electrical connector as claimed in claim 11, wherein said intermediate sections are spring members.

13. An electrical connector as claimed in claim 12, wherein said spring members are S-shape.

14. An electrical connector as claimed in claim 11, wherein said termination sections are posts for positioning in holes in the circuit board.

15. An electrical connector as claimed in claim 11, wherein said termination sections are legs for surface mount connection to the conductive areas of the circuit board.

* * * * *

UNITED STATES PATENT AND TRADEMARK OFFICE

CERTIFICATE OF CORRECTION

PATENT NO. : 5,201,663

DATED : April 13, 1993

INVENTOR(S) : Shoji Kikuchi, et al.

It is certified that error appears in the above-indentified patent and that said Letters Patent is hereby corrected as shown below:

Column 5, line 7, "first" should be --second--.

Column 5, line 8, "second" should be --first--.

Column 5, line 23, "first" should be --second--.

Column 5, line 27, "first" should be --second--.

Column 6, line 3, "portion" should be --portions--.

Column 6, line 18, "first" should be --second--.

Column 6, line 20, "second" should be --first--.

Signed and Sealed this

Twenty-sixth Day of December, 1995

Bruce Lehman

*Attest:*

BRUCE LEHMAN

*Attesting Officer*

*Commissioner of Patents and Trademarks*